US011674781B2

(12) United States Patent
Yntema et al.

(10) Patent No.: US 11,674,781 B2
(45) Date of Patent: Jun. 13, 2023

(54) LEAD FREE FRANGIBLE IRON BULLETS

(71) Applicant: TPI Powder Metallurgy, Inc., St. Charles, MI (US)

(72) Inventors: Stuart Yntema, Saginaw, MI (US); Steven B. Yntema, Saginaw, MI (US); Ted R. Easlick, Saginaw, MI (US); David J. May, Saginaw, MI (US)

(73) Assignee: TPI Powder Metallurgy, Inc., St. Charles, MI (US)

( * ) Notice: Subject to any disclaimer, the term of this patent is extended or adjusted under 35 U.S.C. 154(b) by 0 days.

(21) Appl. No.: 16/779,069

(22) Filed: Jan. 31, 2020

(65) Prior Publication Data

US 2020/0225011 A1 Jul. 16, 2020

Related U.S. Application Data

(63) Continuation-in-part of application No. 14/869,022, filed on Sep. 29, 2015, now abandoned.
(Continued)

(51) Int. Cl.
*F42B 12/74* (2006.01)
*F42B 12/36* (2006.01)
(Continued)

(52) U.S. Cl.
CPC ..... *F42B 12/745* (2013.01); *F42B 12/367* (2013.01); *F42B 12/72* (2013.01);
(Continued)

(58) Field of Classification Search
CPC ..... F42B 12/72; F42B 12/74; F42B 12/80; F42B 12/22; F42B 12/34; F42B 8/00; F42B 8/12; F42B 8/14
See application file for complete search history.

(56) References Cited

U.S. PATENT DOCUMENTS 2,327,885 A * 8/1943 Grace ..... B05D 7/14 86/12
2,409,307 A * 10/1946 Patch ..... F42B 12/74 102/516

(Continued)

FOREIGN PATENT DOCUMENTS

CN 106698598 A * 5/2017

OTHER PUBLICATIONS

Anne Marie Helmenstine, Ph.D, Oxication Definition and Example in Chemistry, Feb. 12, 2020, ThoughtCo., https://www.thoughtco.com/definition-of-oxidation-in-chemistry-605456 (Year: 2020).*

(Continued)

*Primary Examiner* — Derrick R Morgan
(74) *Attorney, Agent, or Firm* — Warn Partners, P.C.

(57) ABSTRACT

The invention relates to bullets having increased frangibility (or which can be easily fragmented) and to powder materials and processes for the manufacture of such bullets. The bullets of the present invention are made from an iron alloy containing 75-81% Hoeganaes MH-100 Iron 0.6-0.09% Carbon, and balance of admixed Copper powder. Said bullets are then coated for lubricity so the bullet does not prematurely wear the barrel of a gun. Additionally, the invention provides a simple low cost process to make bullets that is amenable to mass production via automation.

7 Claims, 6 Drawing Sheets

Related U.S. Application Data

(60) Provisional application No. 62/056,655, filed on Sep. 29, 2014.

(51) Int. Cl.
*F42B 12/72* (2006.01)
*F42B 8/14* (2006.01)
*F42B 12/82* (2006.01)

(52) U.S. Cl.
CPC ..... *F42B 12/74* (2013.01); *F42B 8/14* (2013.01); *F42B 12/82* (2013.01)

(56) References Cited

U.S. PATENT DOCUMENTS 2,411,073 A * 11/1946 Whitney ..... C22C 33/02 419/36
3,403,626 A * 10/1968 Jacobson ..... F42B 5/24 102/435
3,426,684 A * 2/1969 Stig ..... C06B 23/04 102/435
3,463,047 A * 8/1969 Germershausen ..... F42B 8/16 86/23
3,830,157 A * 8/1974 Donnard ..... F42B 5/295 102/464
4,165,692 A * 8/1979 Dufort ..... F42B 8/14 102/506
4,328,750 A * 5/1982 Oberg ..... C08K 3/30 102/376
4,378,256 A * 3/1983 Watson-Adams ..... F41A 21/22 148/253
4,561,889 A * 12/1985 Oaku ..... F01L 1/14 419/60
4,876,050 A * 10/1989 Horton ..... B29C 35/0222 264/102
4,886,637 A * 12/1989 Jandeska, Jr. ..... B22F 3/1003 419/45
4,902,346 A * 2/1990 Leemans ..... F42B 8/16 102/292
4,958,572 A * 9/1990 Martel ..... F42B 12/74 102/506
5,078,054 A * 1/1992 Ashok ..... F42B 12/74 102/506
5,198,616 A * 3/1993 Anderson ..... F42B 12/74 102/501
5,917,143 A * 6/1999 Stone ..... F42B 12/74 102/506
6,090,178 A * 7/2000 Benini ..... F42B 12/74 75/245
6,536,352 B1 * 3/2003 Nadkarni ..... B22F 1/0003 102/506
6,551,376 B1 * 4/2003 Beal ..... B22F 1/0003 419/37
6,691,623 B1 * 2/2004 Stone ..... B22F 1/0014 102/506
6,892,647 B1 * 5/2005 Stone ..... B22F 1/0014 102/506
7,150,233 B1 * 12/2006 Eberhart ..... F42B 12/74 102/516
7,159,519 B2 * 1/2007 Robinson ..... B22F 3/1241 102/501
7,685,942 B1 * 3/2010 Powers, Jr. ..... F42B 8/12 102/506
9,188,416 B1 * 11/2015 Hash ..... C21D 9/0068
2002/0136658 A1 * 9/2002 Dilmore ..... B22F 3/156 419/6
2003/0101891 A1 * 6/2003 Amick ..... F42B 12/34 102/514
2003/0161751 A1 * 8/2003 Elliott ..... F42B 12/74 419/36
2004/0112243 A1 * 6/2004 Amick ..... C22C 1/045 102/517
2004/0255812 A1 * 12/2004 Bourne ..... F42B 1/032 102/476
2005/0016411 A1 * 1/2005 Amick ..... F42B 12/74 102/501
2005/0211126 A1 * 9/2005 Hurley ..... F42B 12/74 102/517
2005/0268809 A1 * 12/2005 Smith ..... F42B 12/72 102/517
2006/0107863 A1 * 5/2006 Powers ..... F42B 12/72 102/517
2007/0131141 A1 * 6/2007 Masatoki ..... H05K 3/3485 106/287.16
2008/0041271 A1 * 2/2008 Ragan ..... F42B 12/06 106/286.4
2010/0147504 A1 * 6/2010 King ..... E21B 43/119 166/55
2012/0067245 A1 * 3/2012 Masinelli ..... F42B 30/02 102/516
2012/0204708 A1 * 8/2012 Pearson ..... F42B 33/00 86/57
2012/0255398 A1 * 10/2012 Schade ..... C22C 38/54 75/228
2012/0279412 A1 * 11/2012 Hash ..... C22C 1/04 102/506
2012/0294751 A1 * 11/2012 Joys ..... C22C 1/0425 419/66
2012/0308426 A1 * 12/2012 Perez ..... F42B 8/14 419/66
2013/0224060 A1 * 8/2013 Hanejko ..... B22F 1/0059 419/66
2014/0260926 A1 * 9/2014 Poore ..... F42B 33/002 86/55
2014/0291570 A1 * 10/2014 Klausner ..... H01F 1/01 252/62.56
2015/0268019 A1 * 9/2015 Amick ..... F42B 12/78 102/439
2016/0091290 A1 * 3/2016 Sheridan ..... F42B 12/367 102/439
2017/0268858 A1 * 9/2017 Morse ..... F42B 7/08
2020/0141708 A1 * 5/2020 Morse ..... F42B 7/08
2021/0048280 A1 * 2/2021 Morse ..... F42B 30/02

OTHER PUBLICATIONS

Hoganaes, Ancorsteel® 1000 / 1000B / 1000C, 0319-AS1000, pp. 1-5.
Arc Metals, "ARC-42 Remill", www.arcmetals.com/products/remill/arc_42.html, 2—pages, Dec. 11, 2012.
Metal Coatings Corp., "Phoshate Coating & Phosphating", www.metcoat.com/phosphate-coatings.htm, 1—page, Feb. 8, 2013.
Wikipedia, "Phosphate conversion coating", Nov. 7, 2015, <https://en.wikipedia.org/wiki/Phosphate_conversion_coating> (Year: 2015), 3—pages.

* cited by examiner

| Bullets - Sintered Testing 6/:1/2015 | | | | | | |
|---|---|---|---|---|---|---|
| | | | | | | |
| 1,400 Deg. Sinter (F-1) No Hydrogen 5.5 B/S | | | | | | |
| Hardness O.D. (Rf) | O.D. | Start Height | 2,500 crush height | Lbf | 5,000 lbf crush height | Lbf Fail |
| 44.0 | 0.3580 | 0.5303 | 0.4932 | 2535 | N/A | 4720 |
| 44.0 | 0.3579 | 0.5320 | 0.4941 | 2515 | N/A | 4695 |
| 44.0 | 0.3580 | 0.5298 | 0.4935 | 2500 | N/A | 4670 |
| 42.0 | 0.3580 | 0.5316 | 0.4943 | 2500 | N/A | 4610 |
| 44.0 | 0.3579 | 0.5318 | 0.4941 | 2500 | N/A | 4630 |
| 43.6 | 0.35796 | 0.5311 | 0.4938 | AVG | 0.0000 | 4665 |

FIG - 7

LEAD FREE FRANGIBLE IRON BULLETS

CROSS-REFERENCE TO RELATED APPLICATIONS

The instant application is a continuation in part of U.S. patent application Ser. No. 14/869,022, filed Sep. 29, 2015, which claims the benefit of U.S. Provisional Patent Application No. 62/056,655, filed Sep. 29, 2014. The disclosures of the above applications are incorporated herein by reference.

FIELD OF THE INVENTION

The present invention relates to a frangible firearm projectile.

BACKGROUND OF THE INVENTION

Traditionally, bullets for small arms ammunition have been manufactured from lead and lead alloys. The major advantages of lead as a bullet material are its relatively low cost, high density and high ductility. The high density of lead has been important to bullet design because the energy generated by the weight of a bullet has generally been thought to be important to the proper functioning of modern semi-automatic and automatic weapons, the in-flight stability of the round, and the terminal effects of the bullet.

The highly toxic nature of lead, however, and its propensity to fume and generate airborne particulate, place the shooter at an extreme health risk. The more a firing range is used, the more lead residue builds up, and the greater the resulting lead fume and lead dust pollution (particularly for indoor ranges). Moreover, the lead bullet residue left in the earthen berm of outdoor ranges can leach into the soil and contaminate water tables. In order for indoor ranges to operate safely, they require extensive and expensive air filtration systems, and both indoor and outdoor ranges require constant de-leading. These cleanup operations are time consuming, costly and repetitive. Accordingly, there is a great need for lead free bullets.

Additionally, personnel at range operations are concerned with the ricochet potential and the likelihood of causing "back-splatter" of the training ammunition. Back splatter is a descriptive term for bullet debris that bounces back in the direction of the shooter after a bullet impacts on a hard surface, such as steel targets or backstops. Ricochets present a significant hazard to individual equipment and structures in and around live firing ranges. A ricochet can be caused by a clanking impact by a bullet on almost any medium. Back splatter presents a significant danger to shooters, training personnel standing on or around the firing line and observers. When a bullet strikes a hard surface at or near right angles, the bullet will either break apart or deform. There is still energy in the bullet mass however, and that mass and its energy must go somewhere. Since the target material or backstop is impenetrable, the mass bounces back in the direction of the shooter.

It is believed that a keyway to minimizing the risk of both ricochet and back splatter is to maximize the frangibility of the bullet. By designing the bullet to fracture into small pieces, one reduces the mass of each fragment, in turn reducing the overall destructive energy remaining in the fragments.

Several prior art patents disclose materials and methods for making non-toxic or frangible bullets or projectiles, U.S. Pat. No. 5,442,989 to Anderson discloses projectiles wherein the casing is frangible and made out of molded stainless steel powder or a stainless+ pure iron powder mix with up to 2% by weight of graphite. The casing encloses a penetrator rod made of a hard material such as tungsten or tungsten carbide.

U.S. Pat. No. 4,165,692 to Dufort discloses a projectile with a brittle sintered metal casing having a hollow interior chamber defined by a tapering helix with sharp edge stress risers which provide fault lines and cause the projectile to break up into fragments upon impact against a hard surface. The casing is made of pressed iron powder which is then sintered.

U.S. Pat. No. 5,399,187 to Mravic et al discloses a lead free bullet which is comprised of sintered composite having one or more high density powders selected from tungsten, tungsten carbide, ferrotungsten, etc. and a lower density constituent selected from tin, zinc, iron, copper or a plastic matrix material. These composite powders are pressed and sintered.

U.S. Pat. No. 5,078,054 to Sankaranarayanan et. al., discloses a frangible projectile comprising a body formed from iron powder with 2 to 5% by weight of graphite, or iron with 3 to 7% by weight of Al.sub2 sub3. The powders are compacted by cold pressing in a die or isostatic pressing, and then sintered.

U.S. Pat. No. 6,074,454 to Abrams et. al., discloses lead free frangible bullets and process for making same out of copper and copper alloy powders.

SUMMARY OF THE INVENTION

The invention relates to bullet projectiles (see FIG. 1 below) having increased frangibility (or which can be easily fragmented) and to powder materials and processes for the manufacture of such bullets. The projectiles of the present invention are made from powdered iron, at least 95%, with other elements being a lubricant and other iron sintering materials. The projectiles are then resin or plastic impregnated (see below). Additionally, the invention provides a simple low cost process to make bullets that is amenable to mass production via automation.

The invention relates to bullets having increased frangibility (or which can be easily fragmented) and to powder materials and processes for the manufacture of such bullets. The bullets of the present invention are made from an iron alloy containing 75-81% Hoeganaes MH-100 Iron 0.6-0.9% Carbon, and balance of admixed Copper powder. Said bullets are then coated for lubricity so the bullet does not prematurely wear the barrel of a gun. Additionally, the invention provides a simple low cost process to make bullets that is amenable to mass production via automation.

BRIEF DESCRIPTION OF THE DRAWINGS

FIG. 7 is a table showing bullet test data;

DETAILED DESCRIPTION OF THE PREFERRED EMBODIMENTS

Figure 1A:
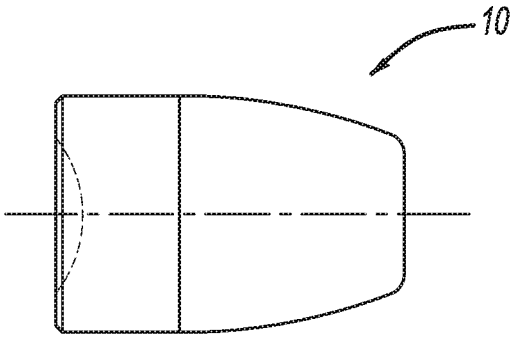
FIG. 1(A) is a side view of a typical bullet projectile made in accordance with the technique of the present invention.
Figure 1B:
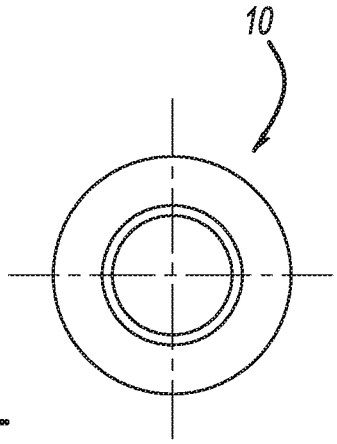
FIG. 1(B) is a front view of the bullet of FIG. 1(A) of the present invention.

The embodiments described in this section are intended as examples only and are not to be construed as limiting. In fact there are hundreds of bullet designs that could be made using the materials and the processes described in this disclosure. Moreover, the present disclosure is not intended as a treatise on bullet manufacturing. Readers are referred to appropriate available texts in the field and any additional and detailed information on bullet manufacture and other aspects of practicing the invention.

Iron is the preferred material of choice for making projectiles of this invention, it is non toxic and has a reasonably high density (6.2 grams/cc minimum). Iron powder technologies typically do not allow for frangibility, but this unique combination of material composition, density and sintering techniques allow for a frangible bullet 10 out of an iron composition. With the addition of outer coatings such as copper plating or phosphates (such as copper, manganese phosphate or zinc coatings) or other plating materials the projectile will have a lubricious coating to not prematurely wear the barrel of a gun. The preferred process to make the bullet of this invention involves first blending the iron powder with a suitable briquetting lubricant, typically composed of Zinc Stearate in amounts of generally from about 0.3% to about 1.0%, and preferably from about 0.6% to about 0.8% wt. % lubricant. Many other briquetting lubricants may also be used such as Acrawax, Kenolube, stearic acid and die wall lubrication systems. Then cold compacting of the powder in a die is facilitated at a pressure that produces a part having a green strength of sufficient interconnected porosity to allow for the lubricant vapor to escape during subsequent sintering treatment. Such cold processing pressures are generally from about 20 tsi to about 50 tsi and typically from about 25 tsi to about 35 tsi. The parts are molded using standard powder metal techniques. The material was pressed at room temperature at approximately 3 tons of force in a 5 ton Mortech compacting press. The iron powder is pressed into a density of 6.2 g/cc minimum of generally from about 6.4 grams/cc to about 7.0 grams/cc, and preferably from about 6.6 grams/cc to about 6.8 grams/cc of said powder.

The bullets 10 are then sintered by heating in a protective or controlled atmosphere to prevent oxidation. The sintering can be done in a standard belt furnace consisting of several "zones". The sintering process consists of loading parts onto a furnace that is divided into heat zones described in order as the Pre-Heat Zone, the Hot Zones and the Cooling Zones. The parts are loaded onto a continuous belt at a fairly rapid belt speed. The atmosphere inside the furnace is controlled to keep moisture and oxygen out of the zones. The temperature of the parts rises to approximately 1400° F. going into and through the Pre-Heat Zone. The parts run through the Hot Zones set to a sintering temperature of generally from about 1000 to 1800° F., typically 1400-1600 degrees F. and preferably 1400 to 1500° F., the exact temperature and time depends on material and the intended frangibility requirements. The parts exit the Hot Zones and enter into the Cooling Zone in an inert (nitrogen) atmosphere. The parts then exit the furnace cool enough to handle.

The final stage of manufacture for the projectiles is impregnation and coating. In order to properly apply the above-mentioned coating to the bullets the projectiles are resin impregnated or "polymerized" as follows. Projectiles are placed into a tank of impregnating material (Loctite PM5120) at room temperature. The tank is sealed and a vacuum is drawn for 30 seconds. Then the tank is left at vacuum for an additional 30 seconds of soak time. During this time the air is removed from inside the pores of the part and replaced with the impregnating material. After exposure to the air, the impregnating material hardens (an anaerobic material) and forms a solid mass within the projectile. This inhibits subsequent cleaning fluids and coating materials from becoming trapped inside the projectile pores. The projectiles then go through a rinse of tri-sodium phosphate to clean the part surfaces.

The projectiles are then copper coated or phosphate coated or otherwise plated to improve the lubricity, for corrosion protection and/or for appearance of the projectile. Standard manufacturing techniques can be used for all these coatings at this point in the process. This is followed with a coating or plating using either copper in accordance with ASTM B734-97 Class 5 or coated with manganese phosphate or zinc phosphate with oil using MIL-DTL-16232 G Class Z Type 2 or plated with any other typical plating materials. This is done for appearance, corrosion protection and lubricity (so the bullet does not prematurely wear the barrel of the gun.

Lower density and lower sintering temperature increase the frangibility while higher density and higher sintering temperature decrease frangibility. The bullets must have sufficient integrity to withstand the firing operation without breaking up in the barrel of the gun or in flight up to the target, the bullet must also have sufficient frangibility so that it breaks up into small pieces upon impact against a hard surface.

It must be noted that different users of ammunition may prefer different degrees of frangibility. Some prefer to have as complete a breakup into as small of particles as possible to eliminate any ricochet or back-splatter and minimize penetration of the steel backstop. Some prefer the breakup into small pieces rather than powder to minimize airborne particles, and at the same time also minimize the ricochet potential.

The technology disclosed in this invention can accommodate most, if not all, of the frangibility requirements. As mentioned above, one way to control frangibility is through control of density, sintering temperature and sintering time.

EXAMPLES

The following examples illustrate embodiments of the process and the lead-free frangible bullets of the present invention.

The material selection in example 1 for the bullet projectile matches the Chemical elements of Metal Powders Industries Federation (MPIF) material grade FY-4500-20V per MPIF standard 35. The projectile does not meet the physical properties of this MPIF grade due to the temperature used for sintering. This material was selected due to its low cost and suitable compressibility in molding. However, the actual material composition for making the bullets would not be restricted to this grade. Any iron based material grade in the standard that is molded to the same density and sintered as described here would give virtually the same flight and fragmentation results. It is primarily the added cost of other alloying elements such as copper in the MPIF FC grades and nickel in the MPIF FN grades and other combinations of alloying elements in the FD, FLN, etc grades that determined the material selected for our use. Also, other alloying elements would not be desirable as cast off metals in the soil.

Example 1

One grade of iron powder produced by Hoeganaes Corporation was blended with die lubricant, assigned these numbers:

1) 96.35% iron with 2.90% FE 3P 16% and 0.75% zinc stearate (lubricant).

2) The base iron material is trademarked under Hoeganaes Corporations name Ancorsteel 1000C. Ancorsteel is a trademark brand of Hoeganaes Corporation.

About a 90 grain sample of the powder blend was pressed (molded) in a die to make the 9 mm projectiles. Projectile size was approximately 9 mm (0.354 inches) diameter×13.5 mm (0.53 inches) long. The bullets were sintered in a belt furnace in a 100% nitrogen atmosphere. Density of bullets was determined using the water immersion technique. Bullets were then resin impregnated and coated with zinc phosphate per MIL-DTL-16232G Class Z Type 2. Other normal plating processes can be used at this point to alter the appearance/color of the bullet. This is followed with a coating or plating using either copper in accordance with ASTM B734-97 Class 5 or coated with manganese phosphate or zinc phosphate with oil using MIL-DTL-16232 G Class Z Type 2 or plated with any other typical plating materials. This is done for appearance, corrosion protection and lubricity (so the bullet does not prematurely wear the barrel of the gun.

Figure 2:
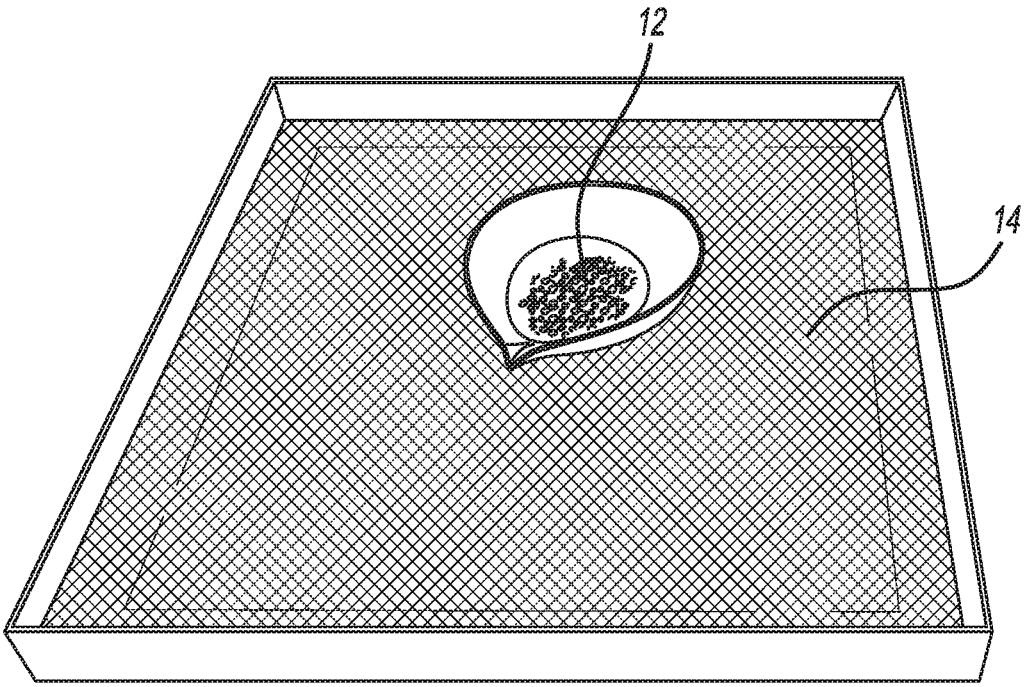
FIG. 2 is a view of a fragmented bullet after firing in a test facility.

The sintered projectiles were assembled into rounds as follows: New Remington cases were purchased. These cases were sized, case mouth expanded, and primed with Winchester Small Pistol primers on an RCBS Rock Chucker press with a RCBS Piggyback II Progressive loader attachment. The powder was loaded into the cases with a Redding Match Grade 3BR Powder Measure with Universal Metering Chamber. The measure was set to throw a 5.3 grain charge of WW-231 smokeless powder, using a RCBS Chargemaster 1500 electronic scale. The bullets were seated on a Redding Big Boss II press. The 9 mm dies that were used throughout were manufactured by Lee Precision, Inc. into 9 mm Luger primed cartridge cases using sufficient commercial smokeless propellant to produce velocities and pressures within the range normally encountered for 9 mm Luger ammunition, and separated into bullet weights and type of bullet lubricant. The completed rounds were test fired. The test setup and pistols used were all commercially available items, 9 mm pistols were used. The absence of the breakup in the barrel or in flight was determined by placing paper witness cards along the flight of the bullet. Frangibility was determined by allowing the bullets to impact a thick (⅝ inch) steel backstop placed perpendicular to the bullets line of flight at the rear end of a wooden collection box. The bullets entered the box through a hole covered with a paper witness card. The fragments generated from the impact of the bullets against the steel plate were collected. The fragments were screened over a Tyler 14 mesh screen 14. The components collected over the screen were labeled fragments, and the material passing through the screen was labeled powder. Each was weighed to detail frangibility.

a) A test round with the resin impregnation and zinc phosphate fragmented as follows:

Total weight prior to screening=5.40 grams (see FIG. 2 below)

Screened powder (or small particles) 12 passing through the 14 mesh screen 14=1.40 grams (26%)

Figure 3:
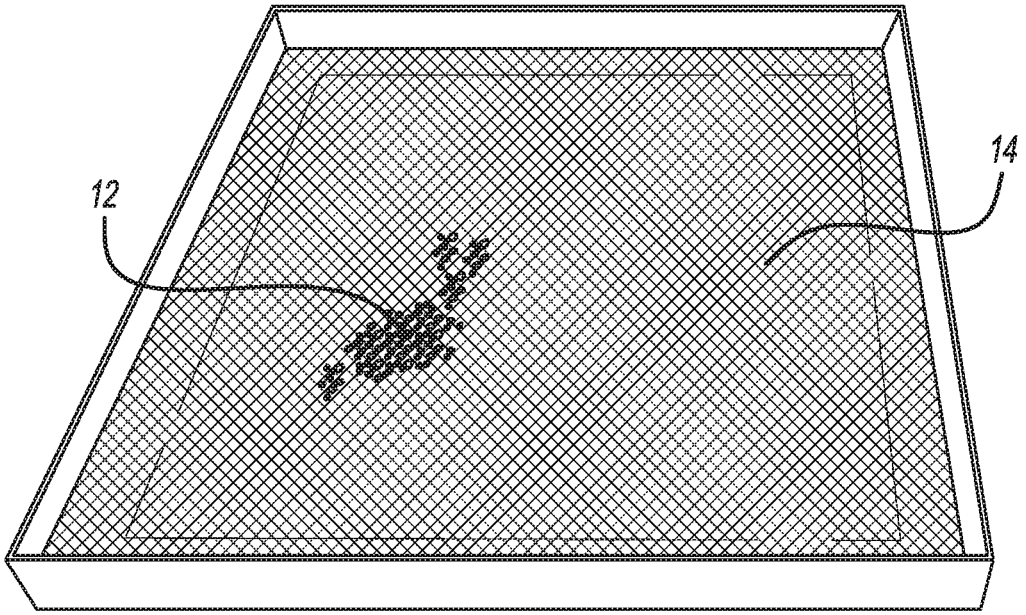
FIG. 3 is a view of particles collected from aa fragmented projectile made in accordance with the teachings of the present invention.

Fragments not passing through the 14 mesh screen=3.90 grams (72%) (see FIG. 3 below).

The balance of 0.10 (2%) grams was attributed to dust lost during screening.

The largest fragment size was no greater than 0.32×0.21×0.18 inches and weighed no more than 0.69 grams (13%).

b) A second test of the bullets from example 1 was completed using 10 rounds and the combined weights were recorded.

Total 10 round weight prior to screening=54.36 grams

Screen powder (or small particles) passing through the 14 mesh screen=17.35 grams (32%)

Fragments not passing through the 14 mesh screen=37.01 grams (68%)

The largest fragment size was approximately 0.21×0.22×0.23 inches and weighed no more than 0.65 grams (12% of 5.436 grams).

Example 2

Additional test firing of bullets made to the same material composition and loading techniques as pre example 1 were conducted. Except in this case the projectiles were copper plated instead of the zinc phosphate coating.

a) A single test round with the copper plating fragmented as follows:

Total weight prior to screening=5.54 grams

Screen powder (or small particles) passing through the 14 mesh screen=1.64 grams (30%)

Fragments not passing through the 14 mesh screen=3.90 grams (70%)

The largest fragment size was approximately 0.19×0.18×0.16 inches and weighed no more than 0.55 grams (10%).

Example 3

Additional test firing of bullets made to the same material composition and loading techniques as per example 1 were conducted. Except in this case the projectiles were molded to a longer length of 15 mm (0.59 inches) and were a slightly higher in weight as noted below. Additionally the parts were plated using a standard zinc plating process to 0.0025 inch plating thickness.

a) A single test round with the zinc plating fragmented as follows: Total weight prior to screening=5.67 grams Screened powder (or small particles) passing through the 14 mesh screen=4.18 grams (74%)

Fragments not passing through the 14 mesh screen=1.48 grams (26%)

The largest fragment size was approximately 0.25×.20×.18 inches and weighed no more than 0.28 grams (5%).

b) A second test of the bullets from example 3 was completed using 10 rounds and the combined weights were recorded.

Total 10 round weight prior to screening=51.95 grams

Screened powder (or small particles) passing through the 14 mesh screen=31.84 grams (61%)

Fragments not passing through the 14 mesh screen=20.05 grams (39%)

The largest fragment size was approximately 0.28×0.28×0.18 inches and weighed no more than 0.48 grams (10% of 5.195 grams).

Frangibility will be "scored" by determining the percentage weight of the largest fragment against the bullets total weight. In the above cases it was 13%, 12% and 10%.

Additional testing was completed on the projectiles prior to assembly into a completed round. Made by PHI corp in The City of Industry, Calif. It is a hydraulic laboratory press generally shows at 16 for load testing parts. It has been retro-fitted with a Dillon FI-127 programmable force indicator (shown in the upper right) that reads the force applied to the ram (shown in the lower left) in pounds of force. One of the parts is shown loaded between the ram 20 and upper stop 22 in FIG. 5 and the resulting effect is shown in FIGS. 6A-6C, showing various tested projectiles 24*a*, 24*b*, and 24*c*.

Figure 5:
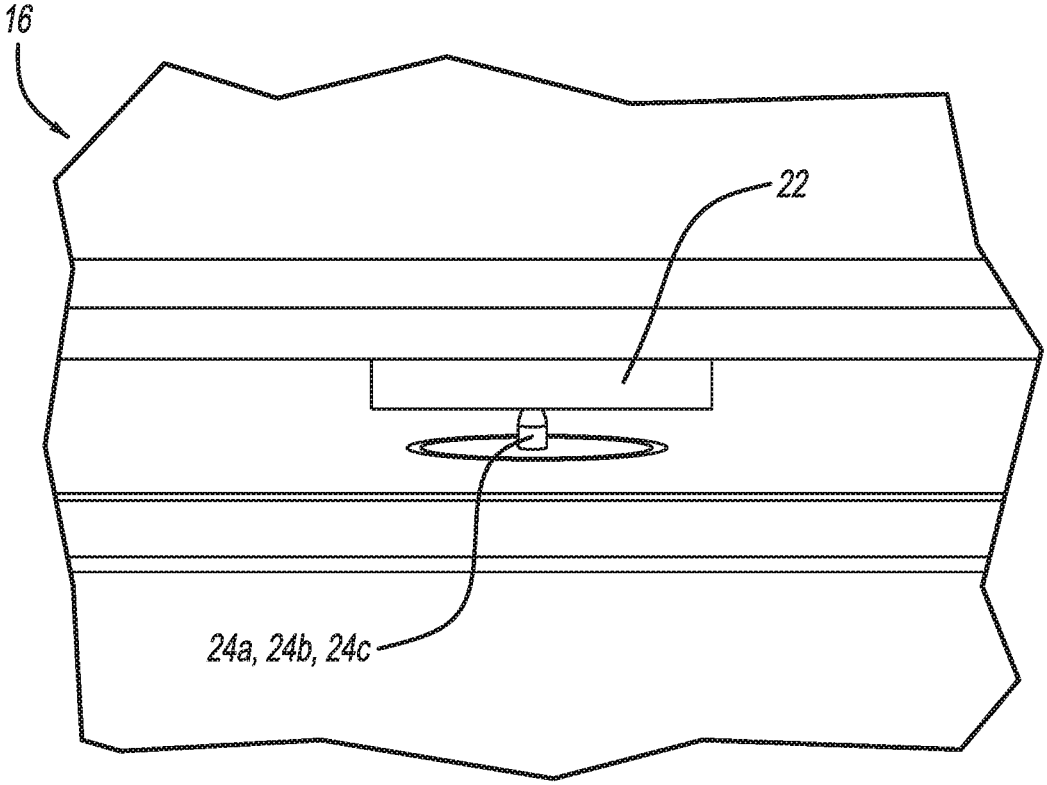
FIG. 5 is a detailed view showing a bullet in the testing apparatus.
Figure 4:
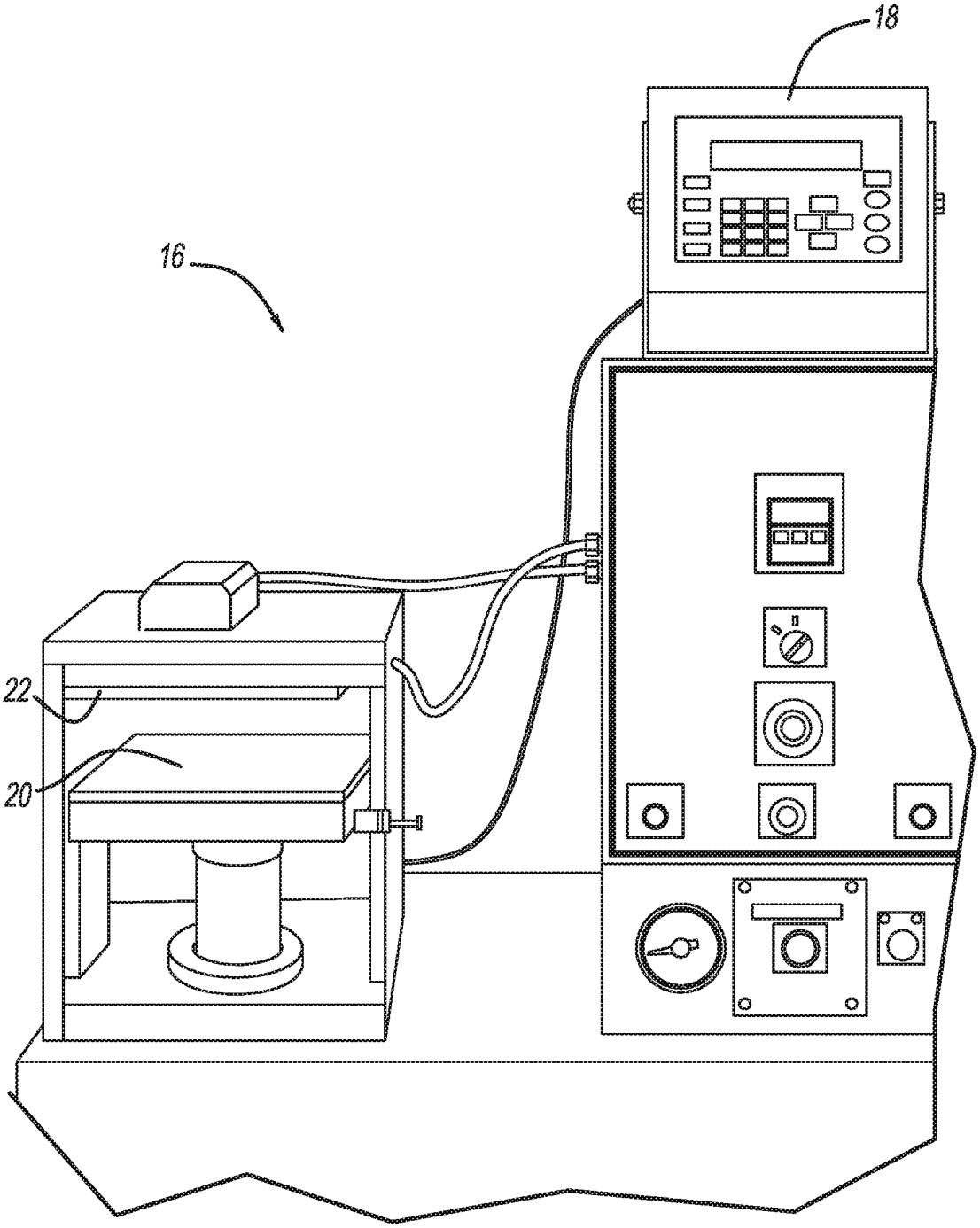
FIG. 4 is a view of the projectile testing equipment.
Figure 6A:
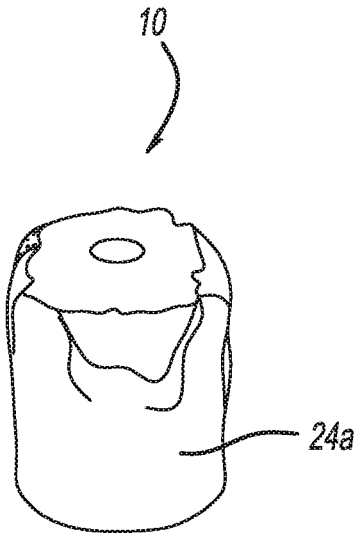
FIGS. 6(A-6C) shows projectiles tested for consistency in the testing apparatus of FIG. 4 prior to loading into a live round.
Figure 6B:
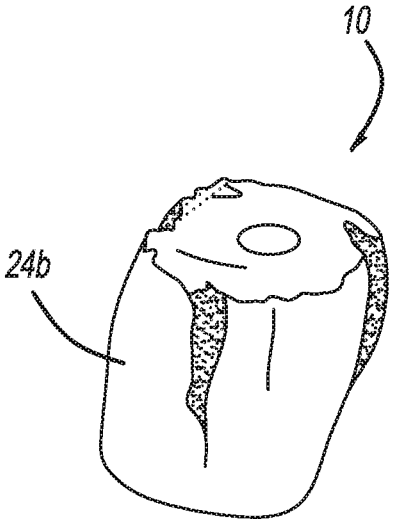
Figure 6C:
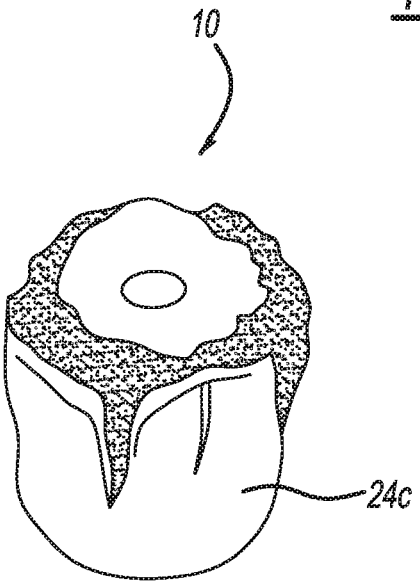

This testing process consisted of loading the projectile into a PHI load tester (see FIG. 4 below) and applying a 2500 pound load (see FIG. 5). The projectiles were measured for length prior to load testing and again after being tested at the 2500 pound load. This change in length testing will be checked over a range of projectile weights, densities and sintering temperatures to give us a baseline for future production and will help to insure consistency of the frangibility at the different parameters. A photo of load tested projectiles 24*a, b* and *c*, and a typical test report are shown below (FIGS. 6A-6C &7).

Higher densities allow heavier bullets to be produced without changing overall dimensions; in fact it is possible to produce 100 grain bullets which compares to 80-93 grain bullets, these bullets more closely resemble the firing characteristics of the conventional lead bullets now used in the field. However, frangibility is greatly reduced.

None of the tested bullets broke up in the gun barrel or flight indicating good integrity. The data shown confirms that the bullets made from the above iron powders had good frangibility. All the bullets did very little damage to the steel backstop. The type of coating did not have any significant impact on performance or frangibility.

Example 4

An Iron material is selected for making a sintered bullet projectile. It is selected to be particular and non toxic and has density ranges of 6.2 to 7.0 grams/cc. The particle size prior to molding ranges from +60 mesh US standard sieve to +325. The iron powder is blended with a suitable briquetting lubricant, composed of Zinc Stearate in amounts of generally from about 0.3% to about 1.0%, and preferably from about 0.6% to about 0.8% wt. % lubricant. Other briquetting lubricants may also be used such as Acrawax, Kenolube, stearic acid or die wall lubrication systems. These may also be used and found suitable. The resultant mixture is cold compacted in a die at a pressure of about 30 tons per square inch. That produces a part having a green strength of sufficient interconnected porosity to allow for the lubricant vapor to escape during subsequent sintering treatment. Cold processing pressures of about 20 tsi to about 50 tsi, typically from about 25 tsi to about 40 tsi and preferably from about 25 tsi to about 35 tsi are used and found suitable.

The green pressed projectile is placed in a continuous belt sintering oven with a 100% nitrogen inert atmosphere. The projectiles on the conveyor are run through a first temperature stage for burning off the lubricant at a temperature of about 1000° F. to 1400° F. and for a time period of about 13 minutes. Then the conveyor transports projectiles to a sintering chamber (hot zone) where the projectiles are sintered at temperatures of about 1400° F. to 1500° F. for about 17 minutes. The projectiles continue into a cooling zone before exiting the furnace.

In accordance with a second alternate embodiment of the present invention there is provided a bullet having increased frangibility (or which can be easily fragmented) and to powder materials and processes for the manufacture of such bullets. The bullets of the present invention are made from an iron alloy containing 75-81% Hoeganaes MH-100 Iron 0.6-0.9% Carbon, and balance of admixed Copper powder. Said bullets are then coated for lubricity so the bullet does not prematurely wear the barrel of a gun. Additionally, the invention provides a simple low cost process to make bullets that is amenable to mass production via automation. Iron powder having a sieve analysis of greater than 50% in the +325 mesh size range is used in the present invention. Also, in a preferred embodiment the projectile contains from about 0.6% to 0.9% and preferably about 0.8% carbon, which also enhances frangibility by reducing ductility and charpy impact strength as compared to materials containing zero carbon and/or materials with a composition of straight Iron.

The projectiles of the present invention are preformed into "green" bullet forms in using the above constituents in the formula. Typically, the bullets are formed in a compression mold at about 30 to 40 tons per square inch prior to placing them into the furnace for final processing.

In the process of the second alternate embodiment of the present invention the bullets are then sintered by heating in a protective or controlled atmosphere to prevent oxidation, the sintering can be done in a belt furnace consisting of several "zones". The first called the "preheat" zone, set to a temperature to burn the briquetting lubricant off, this temperature is from about 1000° F. to 1400° F. The second zone is "high heat" zone is set to a sintering temperature, typically 1725-1800° F. Finally a "cooling" zone where the bullets can cool down and exit the furnace to a temperature which allows the bullets to be handled which is about at or near ambient temperature.

In a preferred embodiment of the second alternate embodiment the iron powder alloy is pressed into a density of greater than or equal to 6.8 g/cc minimum, and typically from about 6.8 to 6.9 g/cc and sintered at a temperature of greater than or equal to 1725° F. minimum for a length of time from 10 to 15 minutes at temperature. Lower density and lower sintering temperature increase the frangibility while higher density and higher sintering temperature decrease frangibility, however, it must be noted that lower temperature also significantly increases the risk of projectile failure when firing or loading. The bullets must have sufficient integrity to withstand the firing operation without breaking up in the barrel of the gun or in flight up to the target, the bullet must also have sufficient frangibility so that it breaks up into small pieces upon impact against a hard surface. There have been instances where the projectiles, sintered below 1700° F. have broken during cycling of the gun and lodged in the magazine and/or barrel. An impact test has been developed that simulates the energy of the impact on the sintered projectiles when fired. We are able to use this to predict the frangibility, we know parts sintered above 1800° F. have significantly reduced frangibility.

It must be noted that different users of ammunition may prefer different degrees of frangibility. Some prefer to have complete breakup into powder to eliminate any ricochet or back-splatter and minimum penetration of the steel backstop. Some prefer the breakup into small pieces rather than powder to minimize airborne particles, and at the same time also minimize the ricochet potential. The technology disclosed in this invention can accommodate most, if not all, of the frangibility requirements. As mentioned above, one way to control frangibility is through control of density, sintering temperature and sintering time. As set forth in the teachings herein.

Through control of density of the control of sintering temperature, or sintering time, or any combination of the above a frangible projectile is produced with the sponge iron and copper mixture.

In order to ensure that the proper conditions for allowing free copper to remain in the sintered sponge iron frangible projectile as shown in FIG. 7*a* at A, it is necessary to carefully select keeping the temperature setting well below the melting point of the copper (around 1970° F.), so that no "hot spots" in the furnace might cause the copper to start to melt, and keeping the sintering time long enough to get an adequate degree of sinter in order to get the projectile to cycle in the gun and fire without breaking. Going above the melting point of the copper will cause the copper to alloy with the iron and have a major impact on the frangibility of the projectile. In addition, it is critical to get to a temperature high enough to get the carbon to diffuse into the iron and reduce the ductility of the iron (above 1475° F.). the best balance of the two is about 1750° F.+/−. The projectile has good sintered strength compared to previous testing at or below 1500° F., where we had serious problems with the projectiles breaking while cycling the shells through a gun.

The time is the other variable used to ensure it is at temperature long enough to achieve sufficient sintered strength and allow enough time for the carbon to at least partially alloy with the iron.

A temperature and time are thus selected wherein the copper is not allowed to melt, we want the free copper to fill the voids in between the iron particles.

Example 5

Formulations are made using Hoganas North American Corporation, Pa., MH100 in amounts of 75, 77, 79-81% (Hoganas MH-100 is a tradename of Hoganas North American Corporation now sold by GPN Hoeganaes under the mark Ancor® MH100) with amounts of iron amounts of in amounts 0.6, 0.7, 0.8 and 0.9% Carbon, in each of these formulations a balance of admixed copper powder is used.

In the first tests each of the mixtures are sintered at a temperature of 1725, 1750, 1775- and 1800-degrees F. For time periods of 11, 12, 13, 14, 15, 17, and 18 minutes. These materials are found to meet testing for 3,400 static load testing, 220 ft-lb impact testing and live round testing.

In a comparison example a composition using 80% Hoganas MH100 sponge iron 0.7% graphite and balance copper is heated at 1750° F. for 17 and 18 minutes and is found to not meet the testing for 3,400 static load testing, 220 ft-lb impact testing and are not suitable for live round testing. This same composition is heated at a lower temperature of 1700° F. and higher temperature of 1825° F. and was found to be unsuitable as a frangible projectile. Projectiles sintered below 1700° F. are found to break during cycling of the gun and lodged in the magazine and/or barrel. We have an impact test we are able to perform on the sintered projectiles that simulates the energy of the impact when fired. We are able to use this to predict the frangibility whereas parts sintered above 1,800° F. are found to have significantly reduced frangibility.

Figure 8A:
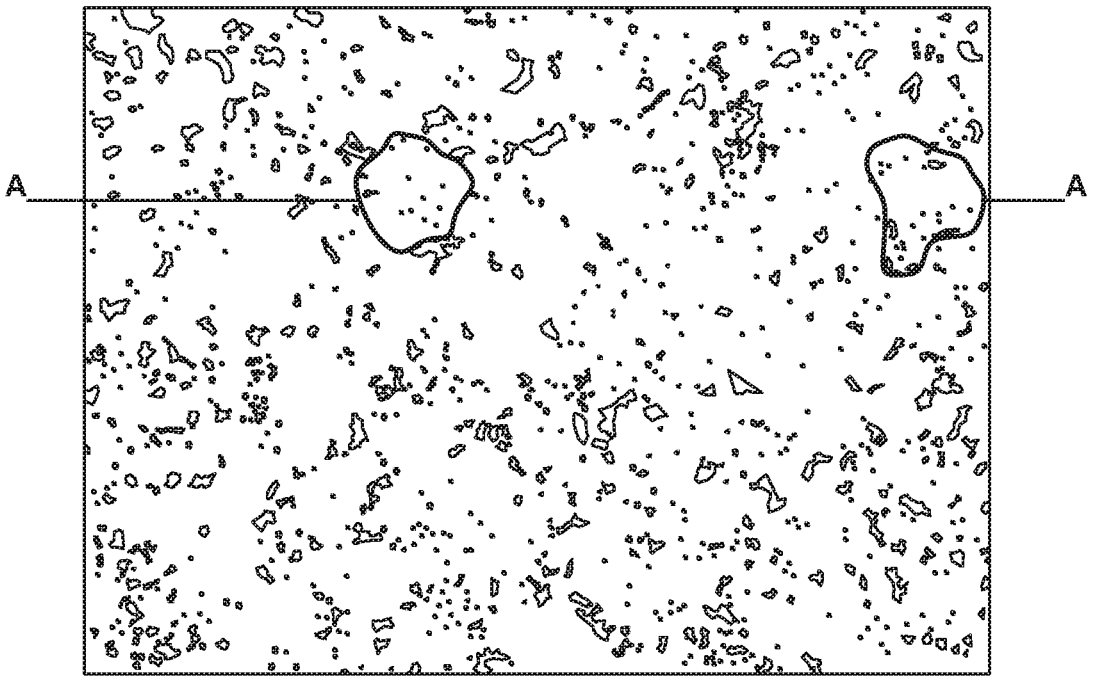
FIG. 8A is a photo micrograph showing the areas of free copper in the porosity between iron particles at areas A.
Figure 8B:
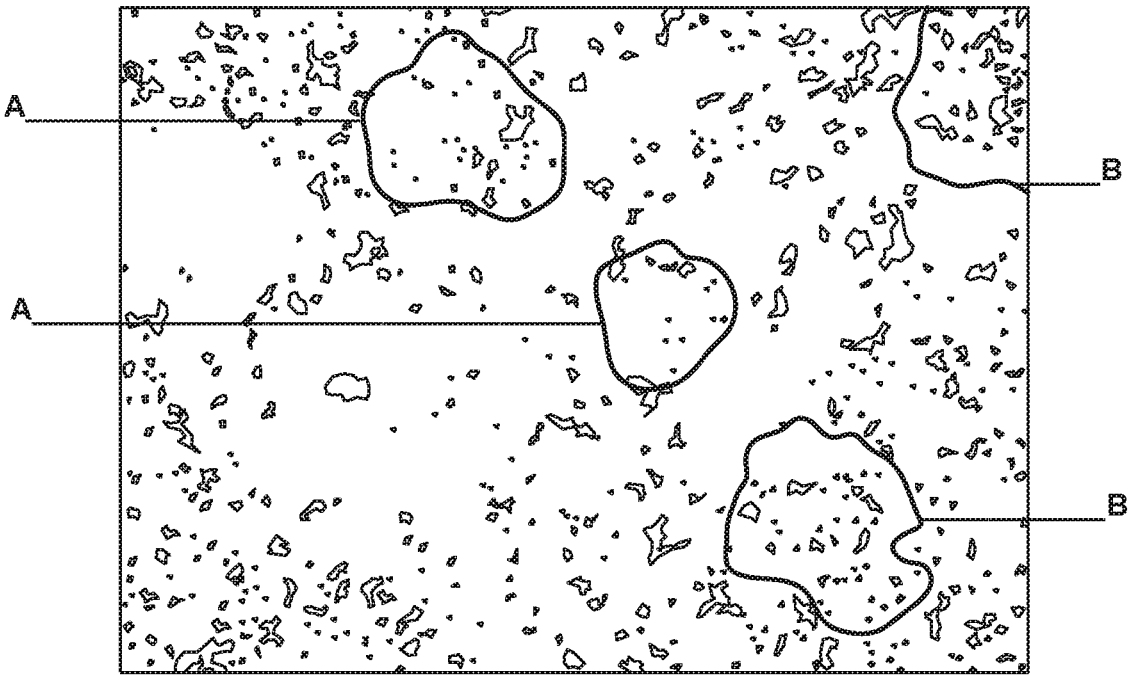
FIG. 8B is a photo micrograph showing the porous MH100 sponge iron material B.

The first slide FIG. 8A shows some photos of a projectile under 400× magnification, this figure illustrates the free copper A in the porosity between the iron particles, and in the next photos FIG. 8B, after etching the microstructure, the effect of the carbon addition to the part is that the carbon combines with the sponge iron particles in areas B for instance during the sinter, and reduces the overall ductility of the material as well. This was not part of the earlier embodiment since the material used did not contain any carbon and was not sintered at a temperature high enough to achieve this result.

By altering the sintering conditions, in this embodiment case from 11 minutes at temperature to 18 minutes at temperature, we have effectively made a significant change to the mechanical properties of the projectile.

The crush strength went up almost 3× and the projectile also failed to sufficiently break up in our simulated frangibility test. We drop a 28 lb. weight from 8 feet onto the projectile to simulate the roughly 220 ft lbs. of impact energy that a 9 mm round generates on impact.

The parts sintered in the planned conditions are also shown with the static load crush strength has gone down to 3,400 lbs., the impact test easily fragmented the bullets and the real test of firing these also resulted in the frangible results we are looking for, so as to produce a bullet capable of fragmenting upon impact with a target.

As the above bullet is comprised of iron-based alloy powders and other elements the bullet is lead free which is desirable in the present application. As in the previous embodiment the bullet is preferably coated to keep the bullet lubricated enough to be fired down the barrel of a gun. Therefore, the outer coatings set forth previously in the application are applied to the projectiles of this alternate embodiment.

Preferably, the sintering is performed in a protective hydrogen/nitrogen atmosphere at a temperature ranging from 1725° F. to 1800° F. for a length of time from 10 to 15 minutes at temperature.

Iron powder having a sieve analysis of greater than 50% in the +325 mesh size range is preferred.

Iron powder is Hoeganaes MH-100. Whereas the large particle size limits iron particle to iron particle mechanical bonds at molding, which then also limits the particle bonds present in sintered bullet, thereby enhancing frangibility with this second alternate embodiment material there would be around 10% less iron particle present than with the previous embodiment material.

The projectile sintering temperature and time combination set forth above allows for sintered bonds. Projectiles sintered below 1450° F. do not create sufficient sintered bonds and are not safe for firing from a gun, these parts sintered below 1450° F. will break during semi-automatic cycling and can lodge in the barrel of the gun.

In the present alternate embodiment, the projectile sintering temperature is below that of the melting point of the copper, which in turn does not allow for alloying of the copper with the iron and leaves the copper in a free state in the sintered component. Free copper in the molded and sintered state impedes the number of mechanical and sintered bonds between iron particles, by filling the space in between therefore also enhancing frangibility.

What is claimed:

1. A frangible bullet consisting of 75-81% sponge Iron with a particle size less than 100 mesh but substantially greater than 325 mesh 0.6-0.9% Carbon, and balance of an amount of Copper which is sintered into a final bullet at a controlled temperature of greater than 1475° F. for allowing the carbon to diffuse into the iron and oxygen free environment to allow for the carbon to at least partially alloy with—the sponge iron wherein the temperature is less than the melting point of copper of 1970° F. which does not allow for alloying with the copper but leaves the copper in a unmelted state allowing the copper to fill the voids between the sponge iron particles so as to produce a bullet capable of fragmenting upon impact with a target wherein the particle size limits iron particle to iron particle mechanical bonds at molding, which then also limits the particle bonds present in sintered bullet, thereby enhancing frangibility.

2. The bullet of claim 1 wherein said bullet is lead-free.

3. The bullet of claim 1 wherein the iron powder having a sieve analysis of greater than 50% in the +325 mesh size range.

4. The bullet of claim 1, wherein carbon is found in an amount of about 0.8%.

5. A method of making a frangible bullet which comprises pressing a powder comprising 75-81% sponge Iron with a particle size less than 100 mesh but substantially greater than 325 mesh 0.6-0.9% Carbon, and balance of an amount of Copper powder which is sintered into a final bullet at a controlled temperature of greater than 1475° F. for allowing the carbon to diffuse into the iron and oxygen free environment to allow for the carbon to at least partially alloy with the sponge iron wherein the temperature is less than the melting point of copper of about 1970° F. which does not allow for alloying of the sponge iron with the copper but leaves the copper in an unmelted state allowing the copper to fill the voids between the sponge iron particles so as to produce a bullet capable of fragmenting upon impact with a target in a die to form a pressed powder compact and subsequently sintering said pressed powder compact, wherein the sintering is performed in a protective hydrogen/nitrogen atmosphere at a temperature ranging from 1725° F. to 1800° F. fora length of time from 10 to 15 minutes at temperature; and wherein the particle size limits iron particle to iron particle mechanical bonds at molding, which then also limits the particle bonds present in sintered bullet, thereby enhancing frangibility.

6. The method of claim 5 wherein pressing of the powder is performed at a pressure ranging from 30 to 40 tons per square inch.

7. The method of claim 5 wherein the Iron powder has a sieve analysis of greater than 50% in the +325 mesh size range.

* * * * *